US007857942B2

(12) United States Patent
Janstaff

(10) Patent No.: US 7,857,942 B2
(45) Date of Patent: Dec. 28, 2010

(54) PAPER MACHINE COMPRISING A TRANSLATION DEVICE

(76) Inventor: Mats Janstaff, Hagvägen 7, S-790 15 Sundborn (SE)

( * ) Notice: Subject to any disclaimer, the term of this patent is extended or adjusted under 35 U.S.C. 154(b) by 852 days.

(21) Appl. No.: 10/593,075

(22) PCT Filed: Mar. 15, 2005

(86) PCT No.: PCT/SE2005/000376

§ 371 (c)(1),
(2), (4) Date: Jun. 28, 2007

(87) PCT Pub. No.: WO2005/088010

PCT Pub. Date: Sep. 22, 2005

(65) Prior Publication Data

US 2007/0284071 A1 Dec. 13, 2007

(30) Foreign Application Priority Data

Mar. 17, 2004 (SE) ..... 0400673

(51) Int. Cl.
*D21F 1/36* (2006.01)

(52) U.S. Cl. ..... 162/263; 162/277; 162/286

(58) Field of Classification Search ..... 162/194, 162/195, 286, 310, 198, 263, 199, 275, 209, 162/257, 260, 355, 356, 277; 83/613, 614; 248/324; 901/15; 414/728; 14/71.5, 45, 14/43, 54, 744.1, 744.5, 749.1, 749.6; 72/88, 72/110; 250/559.01, 559.22, 559.24, 559.33
See application file for complete search history.

(56) References Cited

U.S. PATENT DOCUMENTS 4,003,536 A * 1/1977 Sekerich ..... 248/585
4,299,533 A 11/1981 Ohnaka
4,396,344 A 8/1983 Sugimoto et al.
4,718,815 A * 1/1988 Lindgren ..... 414/729
4,895,314 A * 1/1990 Thievessen ..... 242/559.1
5,762,759 A 6/1998 Wedel
5,967,452 A * 10/1999 Wilder ..... 242/597.4
6,626,408 B1 * 9/2003 Lorbiecki et al. ..... 248/279.1

FOREIGN PATENT DOCUMENTS

| | | | |
|---|---|---|---|
| CA | 2419660 A1 | | 4/2002 |
| EP | 0118845 A1 | | 9/1984 |
| GB | 2189227 A | | 10/1987 |
| GB | 2234569 | * | 2/1991 |
| WO | WO 9011165 A1 | | 10/1990 |

* cited by examiner

*Primary Examiner*—Eric Hug
(74) *Attorney, Agent, or Firm*—Harness, Dickey & Pierce, P.L.C.

(57) ABSTRACT

A paper machine for continuous production of paper in a paper web (4) is described. The paper machine comprises a plurality of drivable rolls (5) for control of the paper web (4) and a translation device for moving a means essentially perpendicular to the paper web (4), which translation device comprises a motor, a holder for the means (16), and an attachment device (17), a first arm (18), being arranged on the attachment device (17) turnable around a first axis (23) of rotation and arranged to be turned by the motor (15), and a second arm (19), being arranged turnable around a second axis (28) of rotation, at a distance from the first axis (23) of rotation, mechanically coupled to the first arm (18). The holder (16) and the mechanical couplings are arranged in such a way that the rotation of the first arm (18) by the motor (15) results in an essentially linear movement of the holder (16).

23 Claims, 3 Drawing Sheets

PAPER MACHINE COMPRISING A TRANSLATION DEVICE

TECHNICAL FIELD

The present invention relates to a paper machine for continuous production of paper in a paper web, which paper machine comprises a translation device for translation of a tool above a surface, particularly a paper web. The tool may be any tool, but the translation device according to the present invention is particularly designed for a cutting tool such as a jet nozzle.

DESCRIPTION OF THE PRIOR ART

Within many areas there is a need to perform a linear motion. The linear motion may be accomplished in many ways. One area within which it is desirable to perform a linear motion is in paper manufacturing. In paper mills paper is produced at high speed in a paper machine. The paper machine has a plurality of rolls through which a paper web runs. The paper web is started in a section of the paper machine in which paper pulp is spread on a wire. The wire, which in principal constitutes a net, runs in an endless loop. When the paper pulp is on the wire, water is allowed to drain from the paper pulp to such an extent that the paper web becomes self supporting. Thus, after the paper web has left the wire, it is self supporting and after having left the wire, the paper web runs through a number of treatment steps comprising pressing, drying and coating. The paper web is transported through the machine by travelling through a number of so called nips, which are constituted by rolls which are arranged adjacently to each other. The paper web runs with a high speed through the machine, usually with a speed of from several hundreds to a few thousand meters per minute. Due to the high speed, small disturbances may cause the paper web to break. Such disturbances may for example be due to different drive speeds in two nips following after each other, that the paper web for some reason locally has a lower strength than the surrounding paper web or that some part of the paper web for some reason is stuck in some part of the paper machine. Due to the high speed of the paper web, large amounts of paper will rapidly go wrong at a break on the paper web.

In paper machines there is usually arranged a so called travelling tail threader in connection with the wire section. The travelling tail threader is arranged to immediately cut the paper web to a desired width in case of a break on the paper web. Due to the high speed of the paper web, cutting of the paper web should be done as soon as possible after the break on the paper web. The paper web may be cut off on a plurality of different places in the machine. The fields of application of tail threaders may be divided in two different main types, namely use for a wet paper web and use for a dry paper web. A first type of travelling tail threaders are nozzles which use a water jet at medium pressure to cut off the paper. Other types of tail threaders are knife tail threaders, which use a knife, radial sword tail threaders, which use a sword blade and water jet tail threaders, which use water under high pressure.

The travelling tail threaders which are used in existing paper machines comprise a translation device in the form of a girder with a carriage which is arranged to move along the girder. The girder is arranged perpendicularly to the paper web. A tool is arranged moveable along the girder in order to make it possible to cut off the paper web in different positions perpendicularly to the paper web. Usually, a first travelling tail threader is arranged at the end of or directly after the wire in order to make it possible to handle breaks in all positions in the machine.

The environment at paper machines and particularly close to the wire is warm and moist and may also be alkaline. With the present travelling tail threaders it occurs that paper pulp which is present in the air around the paper machine, is stuck on the girder. After a while the paper pulp on the girder may drop down on the paper web and cause the paper web to be locally thicker or thinner. There is a risk that the paper web due to being locally thicker or thinner is stuck in some part of the paper machine. This is the case in particular if there is a coater in the paper machine. In such a case there is a risk for the paper web to be stuck in the coater. In some paper machines attempts have been made to solve this problem by heating the lower side of the girder so that no condensation occurs on the girder. This has been achieved for example with steam pipes which lead steam within the girder in order to heat the girder in this way. Despite heating the problem partly remains.

Another problem with the present travelling tail threaders is that it is relatively cumbersome to perform service on the tail threader as the whole girder usually has to be removed in order to make it possible to perform service on it. This often requires the paper production to be shut down during the work.

There are many other applications for a translation device in paper machines. They are, for example, useful for the movement of measuring sensors over the paper web or for the handling of drapery devices which are used to shut off different parts of the paper machine from the surrounding world.

There are also other applications apart from the technical field of paper machines wherein a need exists for a simple translation device. Examples on such applications are spray painting arm, picking arm, feeding arm and lifting arm. Today many of the exemplified duties are performed by robots, but in case the desired movement is a linear movement it may be performed by a translation device.

Thus, there is a need for a linear translation device which is adapted for a tool such as, e.g., a jet nozzle which solves at least some of the above problems.

SUMMARY OF THE INVENTION

One object of the present invention is to provide a paper machine with a linear translation device for a tail threader in a paper machine which solves at least one of the problems with the prior art.

Another object of the present invention is to provide a paper machine with a translation device which achieves translation of a holder without causing problems with drop of paper pulp on the paper web in a paper machine.

Another object of the present invention is to provide a paper machine with a robust and reliable translation device which may rapidly move a holder.

Still another object of the present invention is to provide a paper machine, having a translation device which solves at least some of the problems with the present paper machines.

Still another object of the present invention is to provide a use of the translation device in a paper machine.

At least one of these objects is achieved with a paper machine and the use according to the independent claims. Further advantages are achieved with the features in the dependent claims.

A paper machine according to the invention for continuous production of paper in a paper web and a plurality of drivable rolls for controlling the paper web, comprises a translation device for transfer of a means essentially perpendicular to the paper web, which translation device comprises a motor, a holder for the means and a attachment device. The paper machine is characterised in that the translation device comprises at least a first arm, which is attached to the attachment device turnable around a first axis of rotation and arranged to be turned by the motor, and a second arm, which is arranged turnable around a second axis of rotation, at a distance from the first axis of rotation, mechanically coupled to the first arm and mechanically coupled to be turned by the turning of the first arm in relation to the attachment device. The holder is arranged turnable around a third axis of rotation, at a distance from the second axis of rotation, on the second arm and mechanically coupled to be turned by the turning of the second arm in relation to the first arm, and wherein the mechanical couplings and distances between the axes of rotation are arranged in such a way that the turning of the first arm by the motor essentially results in a translation of the holder in relation to the attachment device.

With a paper machine according to the invention fast and reliable translation of the holder is achieved. By translation is in this application meant linear movement without turning. In a folded in position the arms may be completely at the side of the paper web. In the folded in position there is, thus, no risk for paper pulp to fall down from the arm onto the paper web and thereby cause a stop. In the folded in position the risk for paper pulp to be stuck on the arm is also almost non-existent. Thus, the risk for paper pulp, which can fall down from the arm when the arm is folded out, to be present is very small. If there would be paper pulp on the arm after all and it would fall down the paper pulp would fall down on the part of the paper web that is to be cut away.

Preferably, the second arm is turnably arranged in the first arm. Thus, only two arms exist. It is, however, of course possible to have more than two arms. Thus, the second arm may be mechanically coupled to the first arm by a third arm and a fourth arm, wherein the third arm is arranged on the first arm turnable around a fourth axis of rotation at a distance from the first axis of rotation, wherein the fourth arm is arranged on the third arm turnable around a fifth axis of rotation at a distance from the third axis of rotation, and wherein the second arm is turnably arranged on the fourth arm. It is of course more technically complicated to have more than two arms, but an advantage may be that the total length on the folded in translation device is smaller with more arms. A man skilled in the art realizes that it is of course possible to arrange any number of arms after each other, but that it has to be an even number in order to achieve a linear motion.

In this description the arms are turnably attached to each other, turnable around axes of rotation, which might be arranged in the ends of the arms. Alternatively, the axes of rotation may be arranged at a distance from the ends of the arms.

The desired mechanical coupling may be achieved in many ways. According to a first alternative a first wheel with a central axis is fixed to the attachment device in such a way that the central axis of the first wheel corresponds to the first axis of rotation, and wherein a second wheel with a central axis is turnably arranged in the first arm and arranged fixed to the second arm in such a way that the central axis and axis of rotation of the second wheel corresponds to the second axis of rotation, and wherein a first transfer means is arranged between the first and the second wheel, in such a way that said mechanical coupling between the motion of the second arm and the motion of the first arm is achieved.

In a corresponding way a third wheel may be arranged fixed to the first arm so that the axis of symmetry of the third wheel corresponds to the second axis of rotation, and wherein a fourth wheel is turnably arranged in the second arm and arranged fixed to the holder in such a way that the axis of symmetry of the second wheel corresponds to the third axis of rotation, and wherein a second transfer means is arranged between the third wheel and the fourth wheel, in such a way that said mechanical coupling between the motion of the holder and the motion of the second arm is achieved.

By central axis for a wheel is in this description meant an axis around which the wheel is rotationally symmetric.

The use of wheels to transfer turning between the arms and to the holder it is favourable to use wheels in some form as it is a component that can be bought relatively cheap. It is, however, possible to achieve the desired mechanical coupling also in other ways. An alternative is to arrange a hydraulic coupling between the movement of the first arm and the movement of the second arm. The movement of the first arm may for this purpose affect a first cylinder which is hydraulically coupled to a second cylinder, wherein the first cylinder has twice as large surface as the second cylinder.

In case that transfer means are arranged between wheels the transfer means may be rotational rods, lines, chains or belts. The material in the transfer means may be any material that are used and that will be used in such transfer means.

At least one of the transfer means may be a turning rod. There are two angled cogwheels arranged on the turning rod which each interact with one of the wheels between which the turning rod is arranged to transfer turning, which wheels also are angled cogwheels.

In order to achieve the desired movement of the second arm the first wheel may have a diameter being twice as large as the diameter of the first wheel. Furthermore, the fourth wheel may have a diameter twice as large as a diameter of the third wheel. In the case of the turning rod the angled cogwheels on the turning rod may be equally large. In this way the desired gearing is achieved.

The mechanical coupling may also be achieved with link arms. The link arms must in this case be arranged on sufficiently long link arms so that the desired movements are achieved. A man skilled in the art being placed at this problem may easily achieve the desired movement with link arms. The first link arm may for this purpose be arranged between the attachment device and the second arm for providing said mechanical coupling to the other arm.

The axes of rotation are preferably essentially parallel to each other. In this way an predictable movement in the plane is achieved.

The distance between the first axis of rotation and the second axis of rotation is preferably as large as the distance between the second axis of rotation and the third axis of rotation. A linear motion is most easily achieved if this relation is fulfilled.

At least one of the first arm and the second arm may have a length axis which is essentially perpendicular to the axes of rotation.

The translation device in a paper machine according to the invention has a number of application areas. It may, for example, be used to hold a spray nozzle in the paper machine which manufactures a paper web being lead through a number of rolls during the manufacturing.

A measuring sensor or a cutting tool may be arranged in the holder.

The different features that have been described above may where applicable be combined arbitrarily in the same embodiment.

Preferred embodiments of the invention will now be described with reference to the appended drawings. On the different drawings corresponding features have been provided with the same reference numerals.

SHORT DESCRIPTION OF THE DRAWINGS

DESCRIPTION OF PREFERRED EMBODIMENTS

Figure 1:
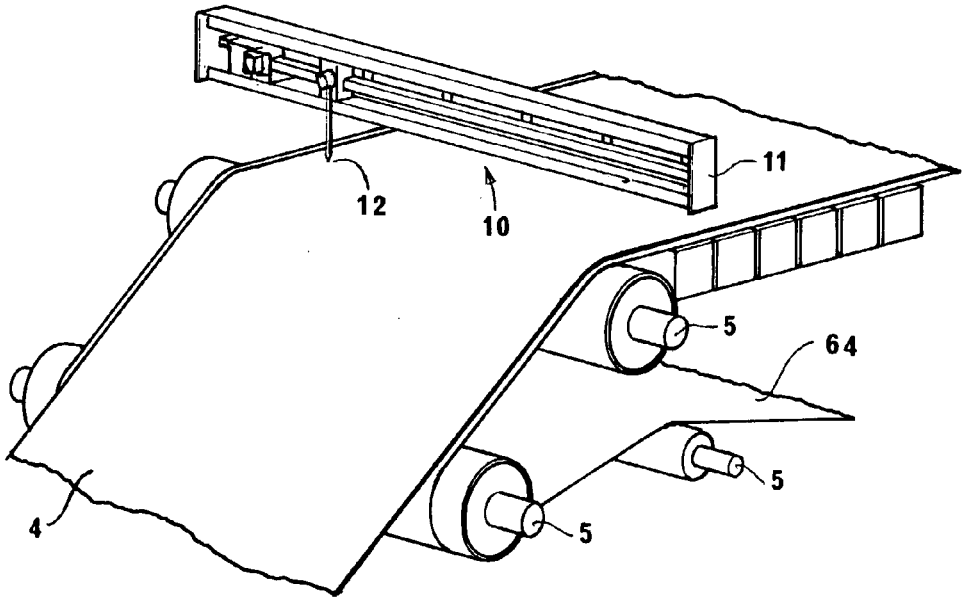
FIG. 1 shows schematically a part of a paper machine in which a linear translation device according to the prior art is arranged.

FIG. 1 shows a part of a paper machine according to the prior art. In paper machines paper pulp is spread on a wire 64, on which it is allowed to dry so that it becomes a self supporting paper web 4. The paper web is then carried by rolls 5. In some cases there is also arranged an upper wire being in contact with the paper pulp. The paper pulp is in such cases arranged between the upper wire and the lower wire. The wire or the wires are carried by rolls 5. After the paper web 4 has left the wire 64 it runs through different treatments. After the wire part there is arranged a tail threading device 10 in the form of a girder 11 and a spray nozzle 12 which is arranged to output a liquid jet.

Figure 2:
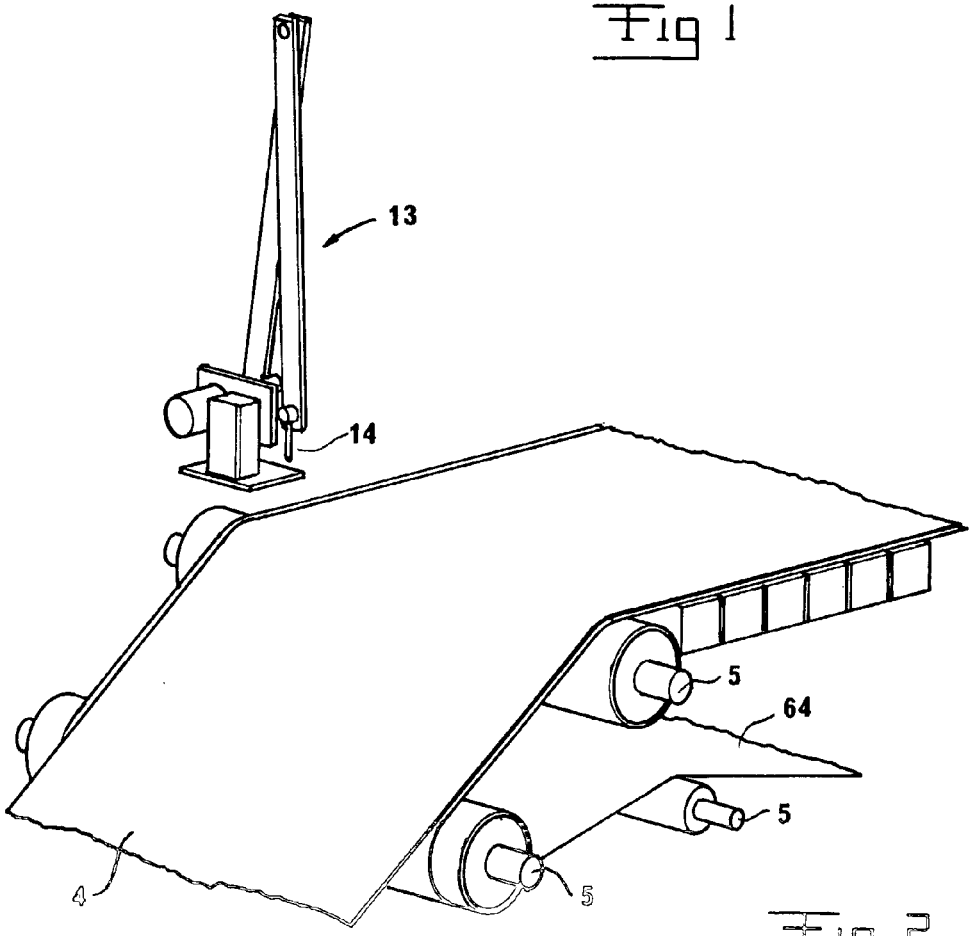
FIG. 2 shows schematically the part of the paper machine in FIG. 2 where the linear translation device has been replaced with a linear translation device according to the invention.

In FIG. 2 the same part of the same paper machine as in FIG. 1 is shown, in which the girder has been replaced by a tail threading device comprising a translation device 13 according to the invention, on which translation device there is arranged a jet nozzle 14 for cutting off the paper web 4. The translation device will now be described in larger detail below. The jet nozzle ejects a medium in a jet. The medium may, for example, be pressurised air or pressurised water.

Figure 3A:
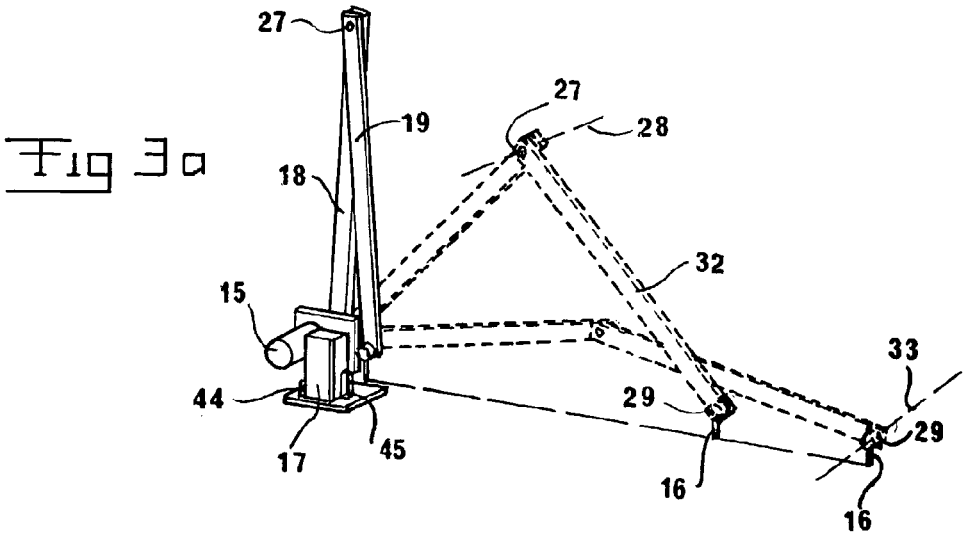
FIG. 3 shows in larger detail a linear translation device according to a first embodiment of the present invention where the transfer of the turning movements is performed using lines.
Figure 3B:
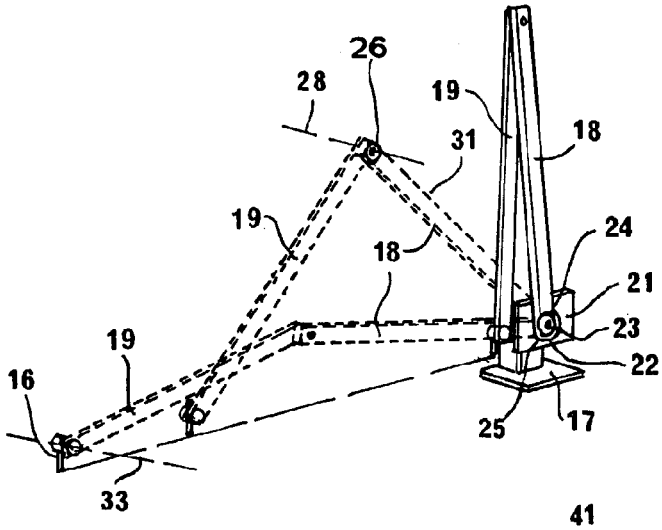

In FIG. 3 a translation device 13 according to the invention is shown. In FIG. 3*a* the translation device 13 is shown from a first side while it in FIG. 3*b* is shown from a second side. The translation device comprises a motor 15, a holder 16, a attachment device 17, a first arm 18 and a second arm 19. The motor 15 may be any type of motor but is preferably an electric motor or an air motor. The motor 15 is provided with a first cogwheel 21, shown in larger detail in FIG. 5, for driving the first arm 18. The first arm 18 is for the purpose coupled to a second cogwheel 22, shown in larger detail in FIG. 5. The motor 15 may thereby turn the first arm 18 by turning the second cogwheel 22 by means of the first cogwheel 21. The first arm 18 turns around a first axis of rotation 23. As is shown more clearly in FIG. 5 the first arm is suspended in such a way that it may be turned around a pin 25.

A first wheel 24 is fixed in relation to the attachment device so that the central axis of the first wheel corresponds to the first axis of rotation 23. By central axis for a wheel is in this description meant the axis around which the wheel is rotationally symmetric. In the figure the first wheel 24 is arranged on the pin 25. It is however possible to arrange the first wheel 24 fixed in relation to the attachment device without arranging the first wheel 24 on the pin 25 as is shown in the figure. A second wheel 26 is arranged turnable around a second axis of rotation 28 in the second end of the first arm 18. The second wheel is mounted in bearings in and runs through the first arm 18. The second arm 19 is fixed in relation to the second wheel 26. A third wheel 27 is fixed in relation to the first arm 18. The central axis of the third wheel 27 coincides with the second axis of rotation 28 and thus with a central axis of the second wheel.

The holder 16 is together with a fourth wheel 29 turnably arranged on the second arm. The holder 16 and the fourth wheel 29 are turnable around a third axis of rotation 33. A first transfer means 31 is arranged between the first wheel 24 and the second wheel 26 for transfer of turning movements between the first wheel 24 and the second wheel 26. A second transfer means 32 is arranged between the third wheel 27 and the fourth wheel 29 for transfer of turning movements between the third wheel 27 and the fourth wheel 29. The distance between the first axis 23 of rotation and the second axis 28 of rotation is as large as the distance between the second axis 28 of rotation and the third axis 33 of rotation.

The wheels that have been mentioned above may be arranged in a plurality of ways. Those wheels that are turnably arranged may for example be arranged on an axle.

The transfer means 31, 32, for transfer of turning movements between the wheels 24, 26, 27, 29, are adapted to the wheels. According to a first embodiment the wheels 24, 26, 27, 29 are line wheels and the transfer means 31, 32 are lines. To prevent the lines from slipping on the line wheels, the lines may be attached to the line wheels 24, 26, 27, 29. To allow sufficiently large turning, the lines 31, 32 may be arranged to run more than one turn around the line wheels 24, 26, 27, 29 which is more clearly shown in FIG. 5 and FIG. 6. The lines may be any kind of lines. For example, the lines may be steel lines, or lines of synthetic fibres such as e.g., Dyneema®.

According to a second embodiment of the transfer means 31, 32, they are V-belts and the wheels 24, 26, 27, 29 are adapted for V-belts. The risk for V-belts to slip on the wheels 24, 26, 27, 29, is considerably smaller which means that it is not necessary to fasten the V-belts 31, 32, in the wheels 24, 26, 27, 29. A disadvantage with V-belts is that the resistance is larger. The V-belts may be any type of V-belts available on the market. The V-belts may, for example, be made of metal or be metal reinforced rubber belts.

According to a third embodiment of the transfer means 31, 32, they are chains and the wheels 24, 26, 27, 29, are chain wheels. With chains and chain wheels the risk for slip is relatively small if the chain is kept under sufficient strain.

According to a fourth embodiment of the transfer means 31, 32, they are cog belts and the wheels 24, 26, 27, 29 are cogwheels. With cog belts and cogwheels the risk for slipping is also relatively small if the cog belt is kept under sufficient tension.

Common for all the described embodiments of the transfer means 31, 32, is that the wheels 24, 26, 27, 29, have different size in pairs. The first wheel 24 has twice as large diameter as the second wheel 26 and the fourth wheel 29 has twice as large diameter as the third wheel. This will lead to the wheels being turned differently large angles when the motor 15 drives the first arm 18.

Also common for the described embodiments of the transfer means 31, 32, is that they might be doubled so that there are two transfer means between each pair of wheels 24, 26, 27, 29. This decreases the risk for operation disturbances.

In FIG. 3*a* a control unit 44 is also shown, which is arranged to control the operation of the motor 15. The control unit 44 has a control signal input for receipt of a signal indicating to which position the holder 16 is to be moved. The control unit is also coupled to a position sensor 45 which outputs a signal indicating the position of the holder 16. The position sensor is a laser distance meter and is arranged fixed on the attachment device 17.

In the following the operation of the translation device according to the invention will be described. In FIG. 3 the translation device 13 is shown in three different positions. During operation of the translation device 13 the motor 15 drives the first arm 18 to be turned to the middle position shown in FIG. 3. As the first wheel 24 is still the first transfer means will affect the second wheel 26 to turn. As the first wheel 24 is twice as large as the second wheel 26, the second wheel 26 and the second arm 19 will turn twice as large angle but in the opposite direction compared with the first arm 18. Furthermore, the third wheel 27 will affect the second transfer means. As the fourth wheel 29 is twice as large as the third wheel 27, the fourth wheel 29 and thus also the holder 16 to turn half the angle but in the opposite direction compared with the second arm 19. Thus, the holder 16 will not be turned in relation to the attachment device 17 when the motor 15 drives the first arm 18 to turn. As the distance between the first axis 23 of rotation and the second axis 28 of rotation is as long as the distance between the second axis 28 of rotation and the third axis 33 of rotation, the holder will move linearly when the first arm is turned.

Figure 4:
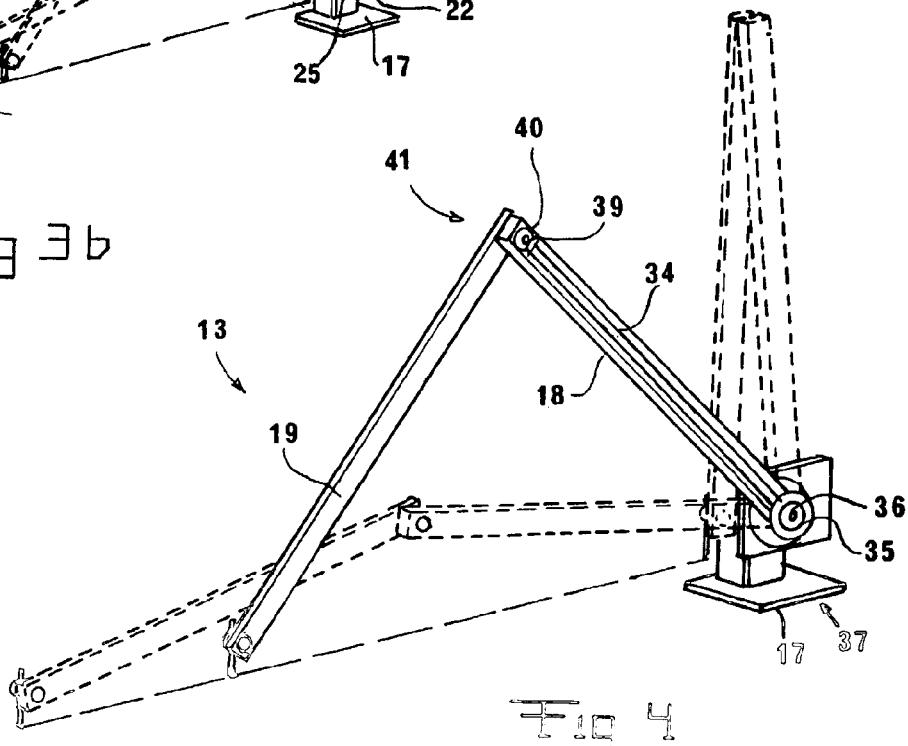
FIG. 4 shows in larger detail a linear translation device according to a second embodiment of the present invention where the transfer of the turning movements is performed using turning rods.

FIG. 4 shows in larger detail a translation device 13 according to a second embodiment of the present invention, wherein the transfer of the turning movements is performed using turning rods 34. The parts of the translation device that are common for the first and the second embodiment have the same reference numerals, while the details that are unique for the second embodiment have their own reference numerals. Only the parts that distinguishes this embodiment from the first embodiment will be described. In the second embodiment a first angled cogwheel 35 is arranged fixed in relation to the attachment device 17. A second angled cogwheel 36 constitutes together with the first angled cogwheel a first angled gear 37. The turning rod 34 is in one end arranged fixed together with the second angled cogwheel 36 and in the other end arranged fixed with a third angled cogwheel 39. The third angled cogwheel constitutes together with a fourth angled cogwheel 40 a second angled gear 41. The fourth angled cogwheel 40 is arranged on the same second axis of rotation as the second arm 19, which has been described in connection with the first embodiment. The gear ratios in the first angled gear 37 and the second angled gear 40 are chosen so that the second arm 19 moves with an angular velocity being twice as high as the angular velocity of the first arm 18 when the first arm 18 is turned around the first axis of rotation. Further, the angled cogwheels 35, 36, 39, 40 are arranged so that the second arm 19 is turned in the opposite direction compared with the turning of the first arm 18. The angled gears are not shown in larger detail as a man skilled in the art easily may arrange them correctly guided by the given description. In the figure is shown only how turning of the second arm 19 in relation to the first arm 18 may be achieved with angled gears. A man skilled in the art may easily arrange angled gears to achieve rotation of the holder in relation to the second arm 19. Instead of angled gears worm gears may be used to transfer turning movements to the rotation rod 34.

During operation of the translation device according to the described second embodiment, the arms will move in the corresponding way as has been described in connection with the first embodiment, with the only difference that the rotational movement is provided with turning rods 34.

Figure 5:
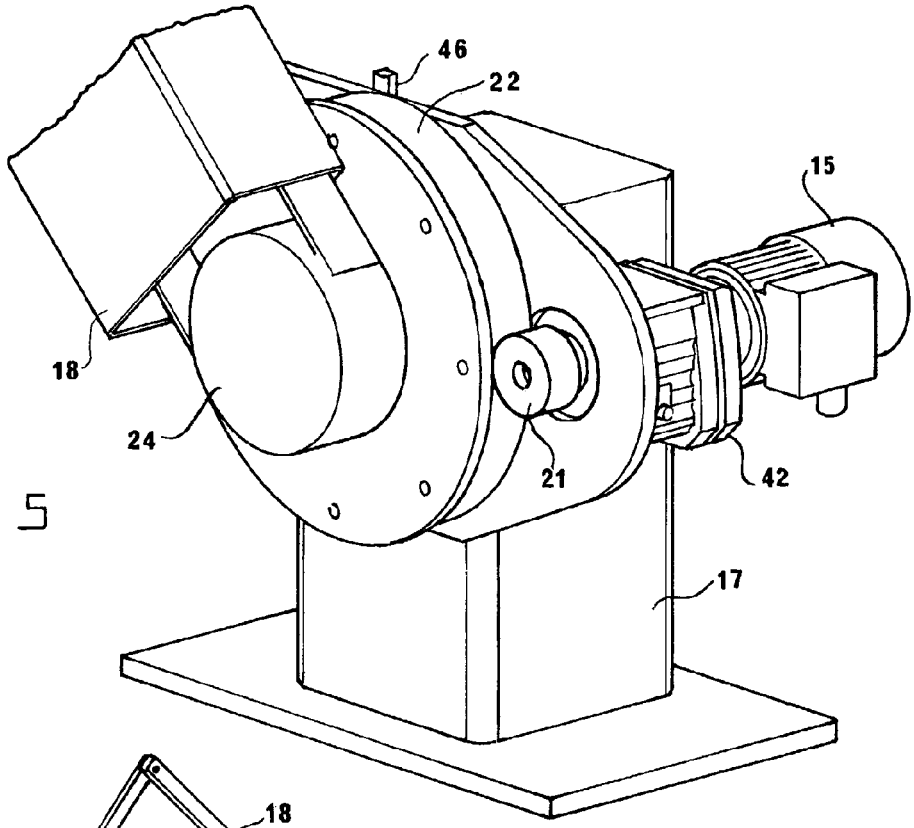
FIG. 5 shows in larger detail how the motor drives the movement of the first arm.

FIG. 5 shows in larger detail how the motor drives the motion of the first arm. The motor 15 is arranged on the attachment device 17. The motor 15 is connected to a gear 42 from which there comes a drive axle with the first cogwheel 21, which drives the second cogwheel 22 which is arranged fixed on the first arm 18. The first wheel 24 is arranged fixed on a part of the attachment device 17 which runs through the centre of the main cogwheel 43. In the figure an alternative position sensor 46 is also shown in the form of an angular sensor which measures the angle between the attachment device 17 and the first arm 18. The information from the angular sensor 46 must be translated to a position by the control unit 44.

Figure 6:
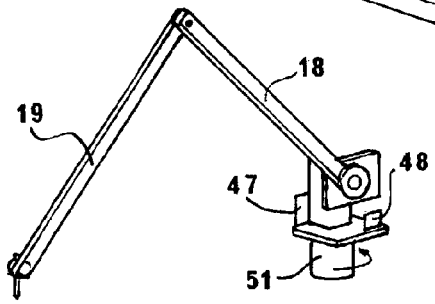
FIG. 6 shows schematically how the first arm alternatively may be driven by a hydraulic cylinder or some other linear device.

FIG. 6 shows schematically how the first arm 18 alternatively may be driven by a hydraulic cylinder 47. The components in FIG. 6 which corresponds to FIG. 3 have the same reference numerals. The hydraulic cylinder 47 replaces the motor 15 and drives the first arm 18 to turn around the first axis of rotation. The hydraulic cylinder 47 is in turn driven by a hydraulic pump 48 which is controlled by the control unit 44. In FIG. 6 is also shown a turning device 51 on which the attachment device is fastened. By means of the turning device 51 the translation device may be rotated for translation of the holder 16 in different directions. The hydraulic cylinder 47 may be replaced with some other sort of linear device.

Figure 7:
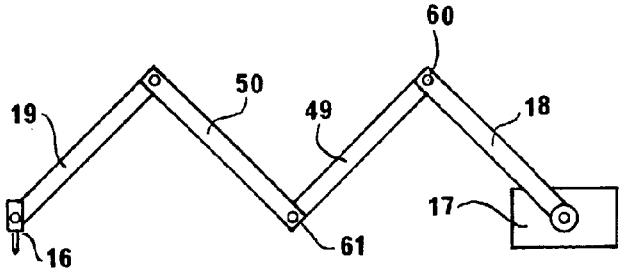
FIG. 7 shows schematically a translation device according to the invention having four arms.

In FIG. 7 a translation device 13 with four arms is shown schematically. The second arm 19 is mechanically coupled to the first arm 18 using a third arm 49 and a fourth arm 50, wherein the third arm is arranged on the first arm 18 turnable around a fourth axis of rotation 60 at a distance from the first axis of rotation 23, wherein the fourth arm 50 is arranged on the third arm 49 turnable around a fifth axis of rotation 61 at a distance from the third axis of rotation, and wherein the second arm 19 is turnably arranged on the fourth arm 50.

Figure 8:
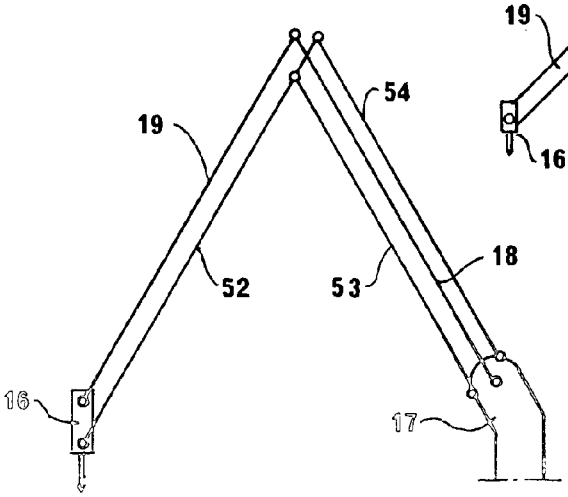
FIG. 8 shows in principal a translation device according to the invention in which the turning movements are transferred using link arms.

In FIG. 8 it is shown schematically how the mechanical couplings may be provided using link arms. In the figure only parts which are unique for this embodiment are shown. The first arm 18 is rotatably attached to the attachment device 17 and is turnable by means of a motor which is not shown in this figure. A second arm 19 is turnably attached to the first arm 18. A holder 16 is turnably arranged on the second arm 19. A first link arm 52 is arranged on the holder 16 and a first junction on the first arm between the attachment device 17 and the attachment point of the second arm 19 in the first arm 18. A second link arm 53 is arranged between the attachment device 17 and a second junction on the first link arm 52. A third link arm 54 is arranged between the attachment device 17 and a third junction on the first link arm 52. The first junction is arranged between the second junction and the third junction. With a translation device according to this embodiment a translation of the holder is provided when the first arm 18 is rotated in relation to the attachment device.

The present invention is not limited to the embodiments described above. A man skilled in the art may modify the embodiments described above in many ways without departing from the scope of the claims which are defined below.

The lines may, for example, as mentioned above be of any material which is possible to use for lines. Examples on such materials are leather, hemp and armed rubber.

Even if the translation device only has been described with two arms above it is obvious for a man skilled in the art that further arms may be arranged between the first and the second arm. In order to achieve a linear motion for the tool holder the number of arms must, however, be even.

It is obvious that the different drives that have been discussed in connection with the embodiments may be combined in the same translation device. Thus, the motion of one of the arms may be driven with, for example, a line while the other arm is driven by a turning rod.

There might be arranged a tool of a large number of different kinds on the holder. Examples on such tools are drilling tools, polish tools, cutting tools, grinding tools, milling tools and brushing tools.

The invention claimed is:

1. A paper machine for continuous production of paper in a paper web, comprising a plurality of drivable rolls for controlling the paper web and a translation device for movement of a means essentially perpendicular to the paper web, which translation device comprises a motor, a holder for the means, and an attachment device, wherein the translation device comprises a first arm, which is attached to the attachment device turnable around a first axis of rotation and arranged to be rotated by the motor, and a second arm, which is arranged turnable around a second axis of rotation at a distance from the first axis of rotation, mechanically coupled to the first arm and mechanically coupled to be turned by the turning of the first arm in relation to the attachment, device, wherein the holder is arranged on the second arm turnable around a third axis of rotation at a distance from the second axis of rotation and mechanically coupled to be turned by the rotation of the second arm in relation to the first arm, and wherein the mechanical couplings and the distances between the axes of rotation are arranged in such a way that the rotation of the first arm by the motor essentially results in a translation of the holder in relation to the attachment device, and wherein a first wheel with a central axis is arranged fixed on the attachment device so that the central axis of the first wheel corresponds to the first axis of rotation, and wherein a second wheel with a central axis is turnably arranged on the first arm and arranged fixed with the second arm so that the rotational axis and central axis of the second wheel corresponds to the second axis of rotation, and wherein a first transfer means is arranged between the first wheel and the second wheel, wherein mechanical coupling is provided between the movement of the second arm and the movement of the first arm.

2. A paper machine according to claim 1, wherein the second arm is turnably arranged on the first arm.

3. A paper machine according to claim 1, wherein the second arm is mechanically coupled to the first arm by means of a third arm and a fourth arm, wherein the third arm is arranged on the first arm turnable around a fourth axis of rotation at a distance from the first axis of rotation, wherein the fourth arm is arranged on the third arm turnable around a fifth axis of rotation at a distance from the third axis of rotation, and wherein the second arm is a turnably arranged on the fourth arm.

4. A paper machine according to claim 1, wherein a third wheel with a central axis is arranged fixed on the first arm so that the central axis of the third wheel corresponds to the second axis of rotation, and wherein a fourth wheel with a central axis is turnably arranged in the second arm and arranged fixed with the holder so that the central axis of the second wheel corresponds to the third axis of rotation, and wherein a second transfer means is arranged between the third wheel and the fourth wheel, in such a way that said mechanical coupling between the movement of the holder and the movement of the second arm is provided.

5. A paper machine according to claim 1, wherein at least one of the transfer means is a turning rod.

6. A paper machine according to claim 5, wherein two angled cogwheels are arranged on the turning rod, each interacting with a respective one of the wheels between which the turning rod is arranged to transfer turning, which wheels are angled cogwheels.

7. A paper machine according to claim 1, wherein at least one of the transfer means is a line and wherein the wheels between which the line transfer turning movement are line wheels.

8. A paper machine according to claim 7, wherein the first wheel has a diameter which is twice as large as a diameter of the second wheel.

9. A paper machine according to claim 4, wherein the fourth wheel has a diameter being twice as large as a diameter of the third wheel.

10. A paper machine according to claim 6, wherein the line is constituted of a synthetic material.

11. A paper machine according to claim 1, wherein at least one of the transfer means is a chain and said wheels, being adapted to interact with the chain, are cogwheels.

12. A paper machine according to claim 11, wherein the first wheel has twice as many cogs as the second wheel.

13. A paper machine according to claim 4, wherein the fourth wheel has twice as many cogs as the third wheel.

14. A paper machine according to claim 1, wherein at least one of the transfer means is a cog belt and said wheels, being adapted to interact with the cog belt, are cogged wheels.

15. A paper machine according to claim 14, wherein the first wheel has twice as many teeth as the second wheel.

16. A paper machine according to claim 4, wherein the fourth wheel has twice as many teeth as the third wheel.

17. A paper machine according to claim 1, wherein the rotational axes are essentially parallel to each other.

18. A paper machine according to claim 1, wherein the distance between the first axis of rotation and the second axis of rotation is as big as the distance between the second axis of rotation and the third axis of rotation.

19. A paper machine according to claim 17, wherein at least one of the first arm and the second arm has a length axis being perpendicular to the axes of rotation.

20. A paper machine according to claim 1, wherein a measuring sensor is arranged on the holder.

21. A paper machine according to claim 1, wherein a cutting tool is arranged on the holder arranged to cut off the paper web.

22. A paper machine according to claim 21, wherein the cutting tool is a jet nozzle being arranged to output a liquid jet.

23. A paper machine for continuous production of paper in a paper web, comprising a plurality of drivable rolls for controlling the paper web and a translation device for movement of a means essentially perpendicular to the paper web, which translation device comprises a motor, a holder for the means, and an attachment device, wherein the translation device comprises a first arm, which is attached to the attachment device turnable around a first axis of rotation and arranged to be rotated by the motor, and a second arm, which is arranged turnable around a second axis of rotation at a distance from the first axis of rotation, mechanically coupled to the first arm and mechanically coupled to be turned by the turning of the first arm in relation to the attachment, device, wherein the holder is arranged on the second arm turnable around a third axis of rotation at a distance from the second axis of rotation and mechanically coupled to be turned by the rotation of the second arm in relation to the first arm, and wherein the mechanical couplings and the distances between the axes of rotation are arranged in such a way that the rotation of the first arm by the motor essentially results in a translation of the holder in relation to the attachment device, wherein the mechanical coupling is provided by means of link arms, and wherein a first link arm is arranged between the attachment device and the second arm to provide said mechanical coupling to the second arm.

* * * * *